US011284687B2

(12) United States Patent
Clougherty

(10) Patent No.: US 11,284,687 B2
(45) Date of Patent: Mar. 29, 2022

(54) DUAL SLIDER MECHANISM FOR INDEPENDENT ADJUSTMENT OF JEWELRY LENGTHS TO MAINTAIN FIT AND STYLE

(71) Applicant: Elise Clougherty, Vienna, VA (US)

(72) Inventor: Elise Clougherty, Vienna, VA (US)

(73) Assignee: Elise Clougherty, Vienna, VA (US)

( * ) Notice: Subject to any disclaimer, the term of this patent is extended or adjusted under 35 U.S.C. 154(b) by 0 days.

(21) Appl. No.: 16/897,569

(22) Filed: Jun. 10, 2020

(65) Prior Publication Data

US 2020/0383435 A1 Dec. 10, 2020

Related U.S. Application Data

(60) Provisional application No. 62/859,680, filed on Jun. 10, 2019.

(51) Int. Cl.

| | |
|---|---|
| ***A44C 5/00*** | (2006.01) |
| ***A44C 15/00*** | (2006.01) |
| *A44C 5/18* | (2006.01) |

(52) U.S. Cl.

CPC ..... *A44C 15/005* (2013.01); *A44C 5/185* (2013.01); *A44C 15/0045* (2013.01); *A44C 15/0085* (2013.01); *A44D 2200/10* (2013.01)

(58) Field of Classification Search

CPC ..... A44C 15/0045; A44C 15/0085; A44C 15/005; A44C 11/005; A44C 5/0061; A44C 5/185; A44C 5/18; A44C 11/00; A44D 2200/10

USPC ..... 63/3, 3.1, 3.2, 4, 41

See application file for complete search history.

(56) References Cited

U.S. PATENT DOCUMENTS

| | | | | |
|---|---|---|---|---|
| 2,291,089 A * | 7/1942 | Okun | ..... | A44B 15/00 24/3.13 |
| 2,713,706 A * | 7/1955 | Biagi | ..... | A44B 6/00 24/66.2 |
| 9,301,580 B1 | 4/2016 | Rafaelian | | |
| D786,118 S | 5/2017 | Rafaelian | | |
| D796,983 S | 9/2017 | Rafaelian | | |

* cited by examiner

*Primary Examiner* — Jack W Lavinder

(74) *Attorney, Agent, or Firm* — Elise Clougherty

(57) ABSTRACT

A dual slider mechanism to independently adjust jewelry lengths to maintain the fit and style of a necklace. This is an article of jewelry comprised of two flexible members and two sliding members with sliding ends and fixed ends such that the sliders attach to the flexible members to permit movement along the flexible members therefore providing a functionally independent interplay between fit and style.

7 Claims, 4 Drawing Sheets

DUAL SLIDER MECHANISM FOR INDEPENDENT ADJUSTMENT OF JEWELRY LENGTHS TO MAINTAIN FIT AND STYLE

CROSS-REFERENCE TO RELATED APPLICATIONS

Provisional application Number: 62/859,680
Filing or 371 (c) date: Jun. 10, 2019

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable.

STATEMENT REGARDING PRIOR DISCLOSURES BY THE INVENTOR OR A JOINT INVENTOR

The claimed invention was first sold to the public on Jun. 12, 2018.

BACKGROUND OF THE INVENTION

Field of the Invention

This invention relates to jewelry. To be more specific, this invention pertains to slider mechanisms for adjustable jewelry.

Description of Related Art

There are various forms of slider mechanisms for jewelry that are designed to adjust the size of the jewelry primarily to achieve a better fit for the wearer. Additionally, a slider attachment fixed to a clasp on the back of a necklace has been used to adjust the overall length of a necklace beyond the standard 16-18 inches.

These sliding mechanisms are effective at adjusting the fit of a piece of jewelry but they are inadequate at adjusting the style of a piece.

This invention provides the additional utility of dynamically changing both the fit and the style of a necklace independent of one another. The dual slider mechanism described below incorporates two independent sliding members, one in the back and one in the front of the necklace, allowing the wearer to create infinite combinations of fit and style.

The usefulness of this invention is that it allows people with different neck sizes to have the necklace lie in the same relative position, preserving the style. Moreover, this invention also allows for unique style or layering regardless of the fit.

In the current marketplace, consumers are restricted to a small range of sizes or a single style per necklace while suppliers are forced to stock many styles and sizes to accommodate the consumer's needs. The additional advantage to this invention is that it is cost-effective for both consumers and suppliers. The consumer has the benefit of wearing a tailor-fitted necklace with many designs in a single piece, while the supplier can stock a single necklace that can be sold to a broad range of consumers.

BRIEF SUMMARY OF THE INVENTION

The purpose of this invention is to provide the wearer with the ability to adjust the dimensions of a necklace to achieve a variety of designs with respect to fit and style. In general, fit describes how the necklace is situated or lies on the neck while style refers to the length of the lariat or location of the pendent. The utility of this invention is achieved by the arrangement of the chains and slider components.

A slider component is attaching to either end of a fixed segment of chain. The chain could be any type of decorative band, cord or cable. A second independent, separate segment of chain (e.g. band, cord, cable) is threaded through the inside of the two slider components. Each of the two slider components can individually move along the second chain. It is recognized that the sliders can both be securely fixed to the same chain or securely fixed to different chains.

Moving the position of either or both of the slider components will result in many independent combinations of fit and style. This is of great advantage to anyone interested in maintaining the style (i.e. length of the lariat) but modifying the fit (i.e. the location of the necklace on the neck) or changing the style and independently adjusting the fit. The fundamental key to this invention is incorporating two chains and two slider components with the two slider components.

The construction of this invention solves the problem inherent to arrangements of a single chain or a single slider component. These configurations force a compromise or dependency between style and fit.

Moreover, this invention is an advantage to both businesses and consumers. Businesses can inventory a single length necklace that meets a broad range of clients. Customers can achieve added value of by changing the appearance of a single necklace.

1 is a slider component, positioned behind the neck.

2 is a slider component, positioned in the front of the neck.

A, B, and C comprise a single, continuous chain (A-B-C), which is threaded through the slider components 1 and 2.

D is a separate chain, affixed to the slider components 1 and 2.

Chain segment C attaches to a pendant, or other article of jewelry.

Figure 1:
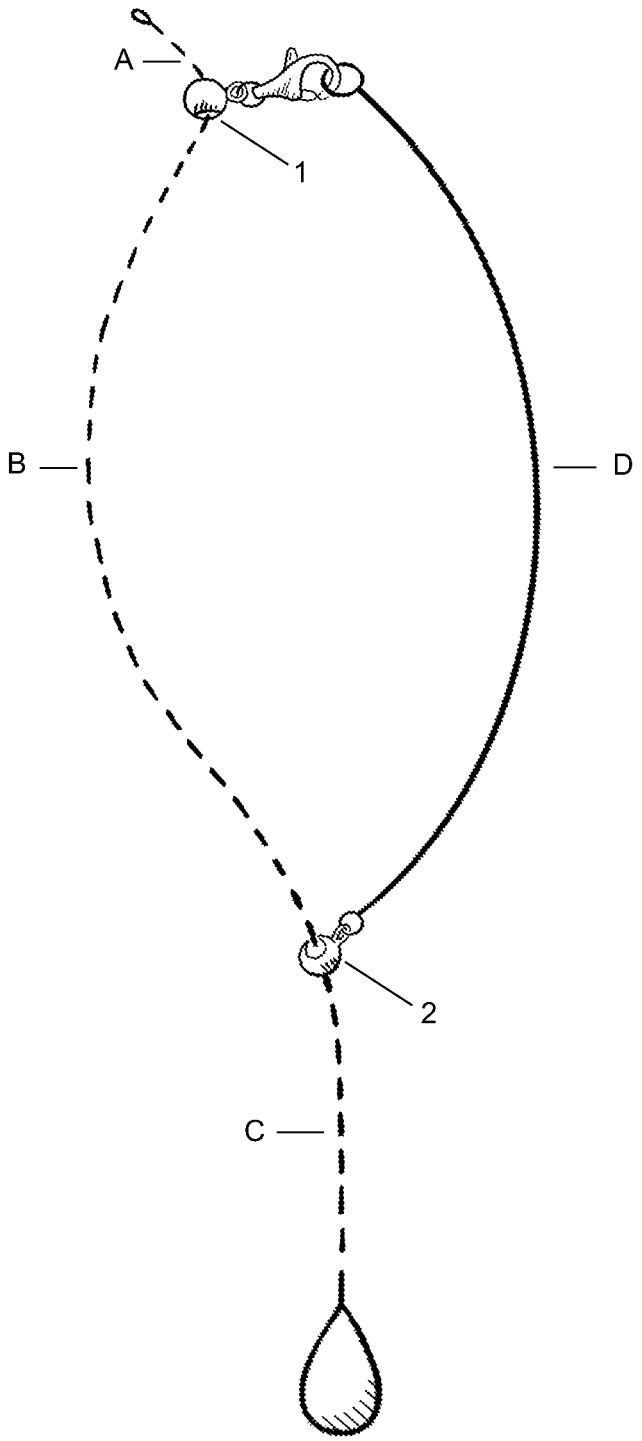
FIG. 1 illustrates the plain view perspective of the dual slider mechanism used in a necklace.
Figure 2:
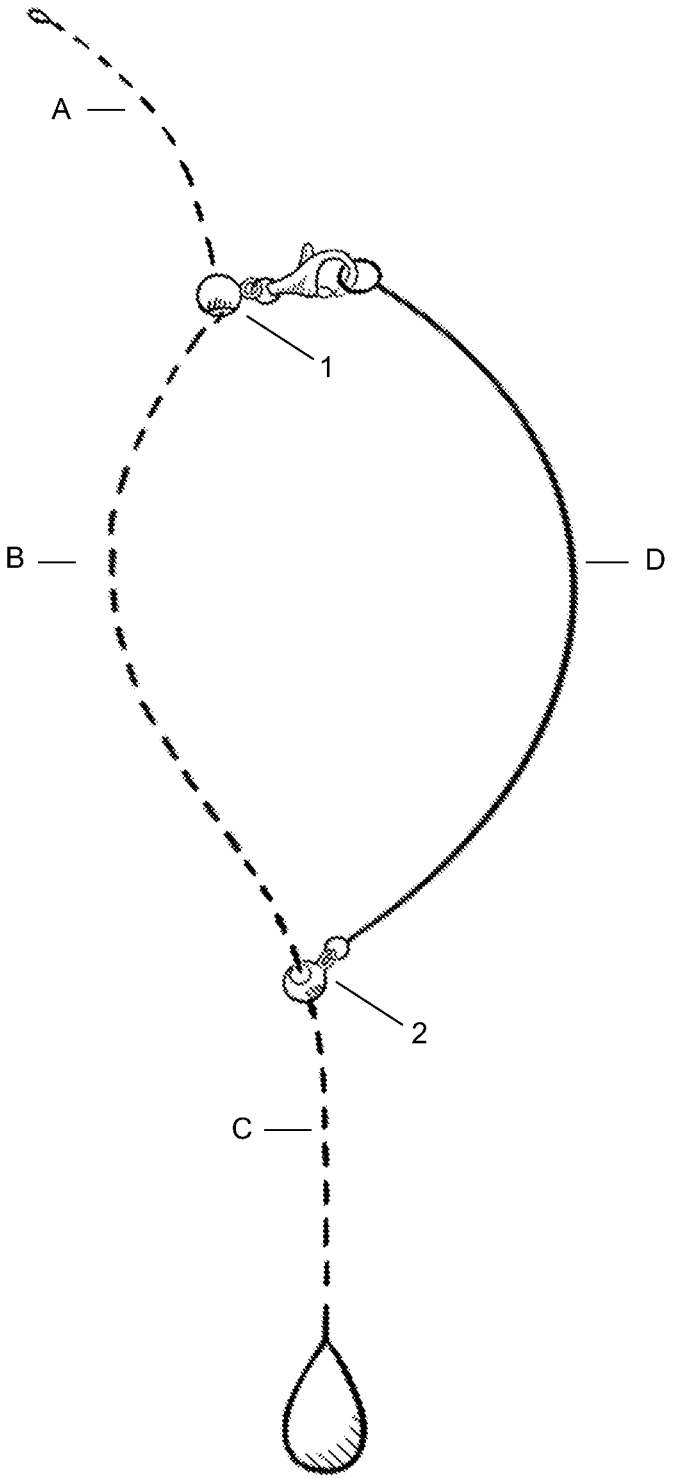

FIG. 2 illustrates the state of the necklace when the fit of the necklace (length of B plus D) has changed from FIG. 1, but the style (length of C) stayed the same as FIG. 1. This state was created by moving slider component 1 along the chain A-B-C to extend the length of segment A.

Figure 3:
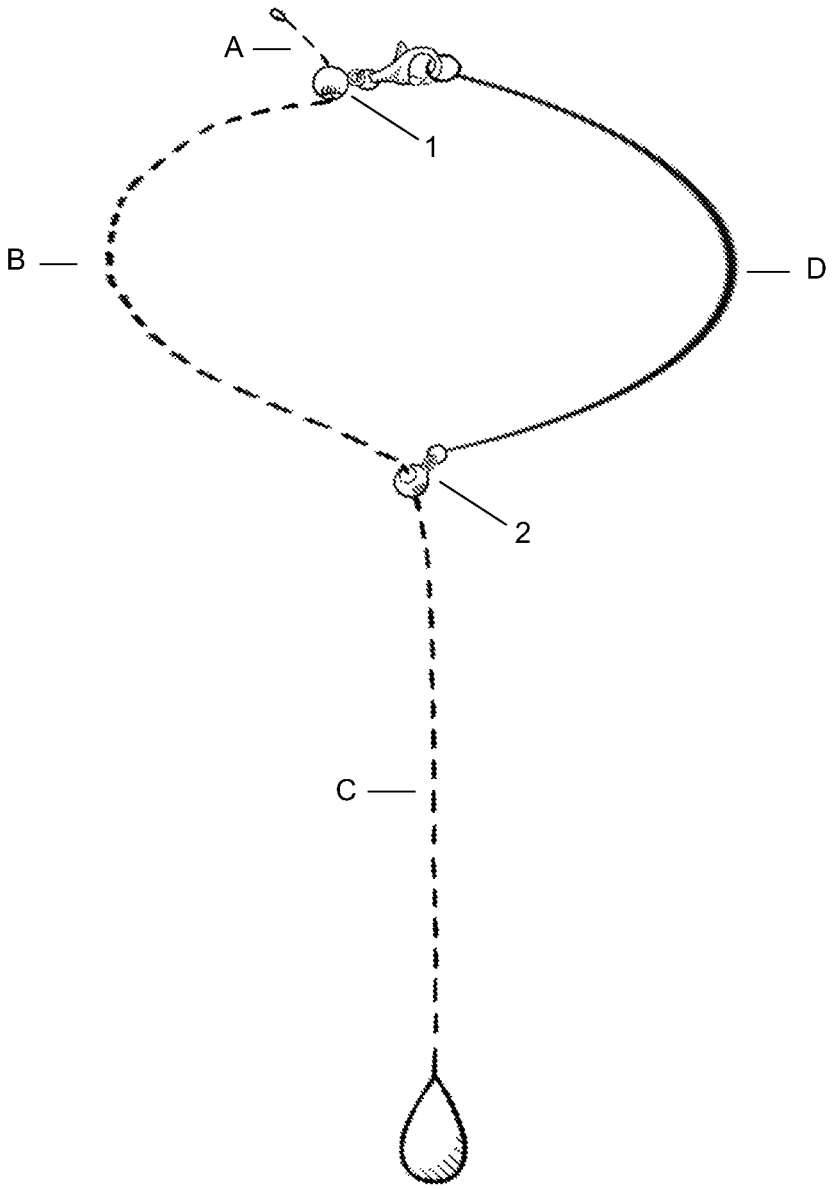

FIG. 3 illustrates slider 2 moving along chain A-B-C to create a longer segment C.

Figure 4:
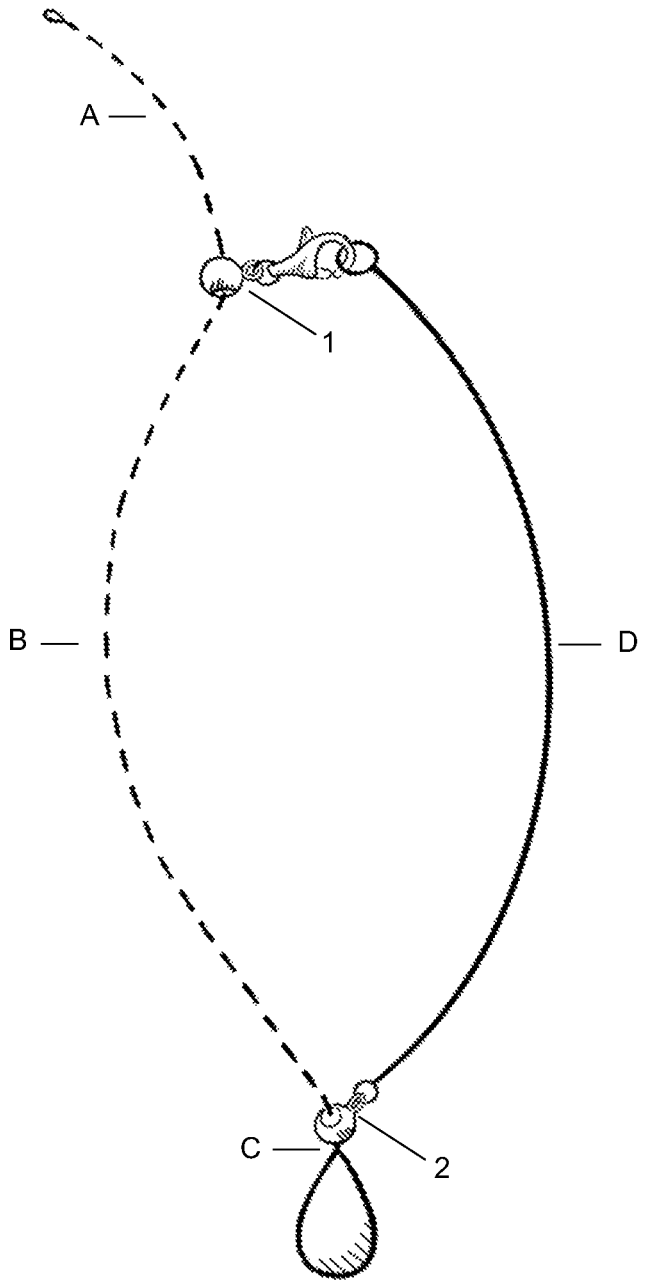

FIG. 4 illustrates the state of the necklace when the style of the necklace (length of C) has changed from FIG. 1, but the fit (length of B plus D) stayed the same as FIG. 1. This state was created by moving slider component 2 along the chain A-B-C to extend the length of segment C.

DETAILED DESCRIPTION OF THE INVENTION

This invention is a dual-sliding mechanism to dynamically adjust the fit and style of an article of jewelry. While this mechanism can be used on an anklet, bracelet, or body chain, its primary use is for a necklace. In general terms, fit describes the size of the necklace around the neck (from tight to loose) while style describes the overall shape of the necklace (from a Y-shape lariat to a simple pendent).

As shown in FIG. 1, the article of jewelry comprises two flexible members and two sliding members. The flexible members have first and second ends and can be made with any suitable material for jewelry (e.g., chain, wire, leather, gold, silver, and/or the like).

The first flexible member is a single, continuous unit comprised of segments A, B, and C. The first end of the first flexible member is part of segment A while the second end of the first flexible member is part of segment C. The second flexible member is D. 1 and 2 are sliding members which both comprise sliding ends and fixed ends. 1 and 2 connect to the first flexible member A-B-C through their sliding ends and they connect to second flexible member D by their fixed ends. This allows the sliders to move freely and independently along the first flexible member. This results in the selective adjustment of lengths of A, B, and C. A simple pendant is attached to C to show the orientation of the necklace. Fit is related to the length of B plus D while style is related to the length of C. In this configuration, A is the tail of the necklace.

FIGS. 1-4 illustrate multiple configurations of the same necklace.

FIG. 2 illustrates the state of the necklace when slider 1 has moved away from the free end of the chain towards the pendent end of the first flexible member, increasing the length of A. Since slider 2 did not move, the length of C stays the same, but the length B is shortened. This configuration adjusts the fit of the necklace by making the circumference of the enclosed loop of the necklace smaller, while maintaining the style of the necklace.

FIG. 3 illustrates the state of the necklace in FIG. 1 when slider 2 moves towards the free end of the first flexible member, thereby increasing the length of C.

FIG. 4 illustrates the state of the necklace in FIG. 1 when both sliders 1 and 2 move along the first flexible member towards its pendant end, adjusting the style of the necklace by transforming it from a lariat to a pendant necklace, while maintaining the fit of the necklace. In this configuration, the length of C is zero.

These figures in this discussion pertain to a single arrangement of sliders and flexible members in which both sliders are on the same chain. The invention is not limited to the precise embodiment of the invention in the illustrations. For example, the sliding elements can be securely fixed to separate chains to achieve the same adaptability of fit and style. While the flexible members on a necklace can have any dimension, if the second flexible member is shorter than the first flexible member, it is recommended the sliding members move along the first flexible member and securely attach to the second flexible member to reduce the chance of the tail of the necklace from coming towards the front of the body. Any enhancement or design element like a pendant can be added to a flexible member. The sliding member may be enclosed within a cover to appear like a single unit.

The novelty of this dual sliding mechanism is that is allows fit and style to be selectively adjusted independently of one another. It achieves more than simply adjusting the size of the jewelry; it allows the size and the style to be adjusted simultaneously.

What is claimed is:

1. An article of jewelry, wherein said article of jewelry is a necklace, comprising:

a first flexible member having a first end, a second end, and a tail segment;

a second flexible member having first and second ends; and two sliding members with sliding ends and fixed ends; wherein said second flexible member is shorter than said first flexible member and said sliding members securely attach to said second flexible member with their fixed ends to permit movement along said first flexible member with their sliding ends to provide a functionally independent interplay between fit and style and to position said tail segment on the back of the wearer.

2. The article of jewelry from claim 1, wherein the fit can be varied without a change in style.

3. The article of jewelry from claim 1, wherein the style can be varied without a change in fit.

4. The article of jewelry from claim 1, wherein said flexible members comprise any decorative material such as chain, including silver, gold or other ornamental metal types, wire, cord, leather, or fabric.

5. The article of jewelry from claim 1, wherein the size of said flexible members or said sliding members can be any dimension within reasonable limits to function as an article of jewelry.

6. The article of jewelry from claim 1, wherein an enhancement like a pendant or other design element can be attached to one or both said flexible members.

7. The article of jewelry from claim 1, wherein said first and second ends of said sliding member are enclosed within a cover to appear like a single unit.

* * * * *